US006131888A

United States Patent [19]

Brown

[11] Patent Number: 6,131,888

[45] **Date of Patent: *Oct. 17, 2000**

[54] METHOD AND CONNECTORS FOR CONSTRUCTION OF PVC GATE STRUCTURES

[76] Inventor: Ralph Wesley Brown, 7025 Niumalu Loop, Honolulu, Hi. 96825

[ * ] Notice: This patent issued on a continued prosecution application filed under 37 CFR 1.53(d), and is subject to the twenty year patent term provisions of 35 U.S.C. 154(a)(2).

[21] Appl. No.: 09/061,359

[22] Filed: Apr. 15, 1998

[51] Int. Cl.[7] ..... E04H 17/16

[52] U.S. Cl. ..... 256/65; 256/59

[58] Field of Search ..... 256/19, 24, 59, 256/65, 66, 73

[56] References Cited

U.S. PATENT DOCUMENTS

| | | | |
|---|---|---|---|
| 4,053,140 | 10/1977 | CLemens . | |
| 4,205,486 | 6/1980 | Guarnacci . | |
| 4,286,372 | 9/1981 | Batcheller . | |
| 4,722,514 | 2/1988 | Pettit . | |
| 4,772,514 | 9/1988 | Pettit | 256/19 X |
| 4,892,292 | 1/1990 | Russell . | |
| 5,161,783 | 11/1992 | German . | |
| 5,192,054 | 3/1993 | Sharp . | |
| 5,362,030 | 11/1994 | Iler . | |
| 5,609,327 | 3/1997 | Amidon | 256/24 |
| 5,713,171 | 2/1998 | Andres | 52/263 X |

*Primary Examiner*—Lynne H. Browne
*Assistant Examiner*—John R. Cottingham
*Attorney, Agent, or Firm*—Seth M. Reiss

[57] ABSTRACT

A polyvinyl chloride ("PVC") elbow connector for joining rail and post members of PVC gate structures, a customizable PVC gate structure incorporating said elbow connector, and a method of constructing PVC gate structures. The elbow connector comprises a molded body shaped to correspond to the gate post and rail members with legs projecting at a ninety degree angle and flanges extending from the inside wall of the end of each leg. The flanged elbow connectors permanently mate with the PVC post and rail members to provide a strong, durable and seamless connection, and facilitate the fabrication of customized gate structures in the field without the cost and delays associated with special order factory gates. According to one embodiment, the gate structure includes metal U-channel inserts positioned snugly within each rail member for added strength and support. The flanged elbow connectors are of one-piece molded construction and gate components are fabricated from virgin PVC impregnated with UV ray inhibitors.

9 Claims, 4 Drawing Sheets

METHOD AND CONNECTORS FOR CONSTRUCTION OF PVC GATE STRUCTURES

BACKGROUND

1. Field of Invention

The present invention relates to polyvinyl chloride ("PVC") fencing. More particularly, this invention describes field customizable PVC gate structures, a method for constructing these gate structures, and a flanged PVC elbow connector employed in the construction of the PVC gate structures.

2. Description of Prior Art

Polyvinyl chloride is commonly used in the manufacture of fencing and fence components. It is the practice of the relevant industry to utilize pre-built PVC gates of standard dimensions to complete PVC fence enclosures. These gates are built by first cutting each end of two standard length PVC gate posts and two standard length PVC gate rails to a 45 degree angle. The ends of the fence posts and rails are then welded together to form a rectangular gate structure. The resulting welded connections are weak and subject to cracking under normal usage.

Known PVC gate construction is not field customizable. If a gate of non-standard dimensions is required, it must be special ordered from and built by the factory. This is due, in large part, to the specialized equipment utilized to weld PVC post and rail members together. Thus, current customized PVC gate solutions add extra costs and unnecessary delays to the fence construction process.

An alternative method for constructing PVC fence gates has been described to involve bolting rail and post gate members to right-angled connectors. In order to be field customizable, such gate assemblies require the work of a skilled craftsperson. After rail and post members are cut to the desired length, holes must be precisely drilled, aligned with holes in the right-angled connector, and then bolted to the right tension. If bolted too tightly, the gate rail and post members tend to cave in and, like the factory welded rail to post connections, are subject to cracking. In addition, the use of nuts and bolts result in a connection which is aesthetically unappealing.

Further limitations exhibited by presently known and available PVC gate structures arise from the nature and characteristics of the PVC material. PVC fencing systems are susceptible to warping, sagging, and decomposition due to the sun's ultraviolet rays. Recycled PVC, as opposed to virgin PVC, exhibits increased susceptibility to sag when exposed to the sun PVC rails longer than three feet are particularly susceptible to sagging, and may warp or break in response to the application of loads.

OBJECTS AND ADVANTAGES OF THE INVENTION

Accordingly, several objects and advantages of the present invention are:

(a) to provide an adaptable connector capable of joining variable-sized PVC gate rail and post members and facilitating field construction of custom fitted PVC gates structures;

(b) to provide an adaptable connector capable of joining PVC gate rail and post members in a manner that is stronger than the currently used welded connections;

(c) to provide an adaptable connector that can be seamlessly mated with PVC gate rail and post members to form an aesthetically pleasing connection;

(d) to provide a connector and method of construction to join PVC gate rail and post members without tools or the skill of a craftsperson;

(e) to provide a PVC gate that can be custom built in the field and a method of construction therefor that avoids the expense and delay of factory orders;

(f) to provide a customizable PVC gate and method of construction therefor that can accommodate rail and/or post members that are sized and cut in the field;

(g) to provide a customizable PVC gate and method of construction therefor having an aesthetically pleasing, seamless connection between rail and post members;

(h) to provide a customizable PVC gate and a method of construction therefor having rail/post joints that are stronger than existing welded connections; and (i) to provide a customizable PVC gate and method of construction therefor that resists sagging, warping and decomposition;

Further objects and advantages of the present invention will become apparent from consideration of the ensuing description and drawings.

SUMMARY OF THE INVENTION

These and other objects are accomplished in the present invention, a flanged PVC elbow connector, the field customizable PVC gate structure it is used to construct, and the method of constructing said PVC gate.

The flanged elbow connector comprises a hollow PVC elbow shaped body having legs formed at a ninety degree angle and flanges extending from the inside wall of each leg to facilitate a secure connection with gate post and rail members. In a preferred embodiment, the flanged elbow connector is of one-piece molded construction and fabricated from virgin PVC impregnated with ultra violet ("UV") ray inhibitors.

The customizable PVC gate structure consists of four flanged elbow connectors, two hollow tubular rail members, two hollow tubular post members, and a plurality of pickets which attach within either the rail or post members. An adhesive is employed to permanently mate the rail and post members with the four flanged elbow connectors, thus forming a seamless, field customizable, aesthetically pleasing gate structure. According to a preferred embodiment, the gate structure is fabricated of virgin PVC impregnated with UV ray inhibitors, and further includes metal U-channel beam inserts fitted snugly inside each rail member to reinforce and strengthen the rail member. A metal or wood insert is employed within the post member intended to be hinged to a fence post.

According to the method of this invention, rail and post members are custom-sized to match the dimensions and style of the surrounding PVC fence system. Pickets are inserted and secured within either the rail or post members according to the style desired. A PVC adhesive is applied to the inside edges of the rail and post members and to the corresponding outside flanged lips of each leg of the four elbow connectors. The ends of the post and rail members are then mated and abutted with the elbow connectors such that each of the four connectors form a corner of the completed gate. The method of construction of the subject invention further includes, in a preferred embodiment, the insertion of a metal U-channel beam into each PVC rail member for added support and stability.

BRIEF DESCRIPTION OF THE DRAWINGS

The details of typical, but not limiting, embodiments of the present invention will be described in connection with the accompanying drawings.

DETAILED DESCRIPTION OF THE PREFERRED EMBODIMENTS

Figure 1:
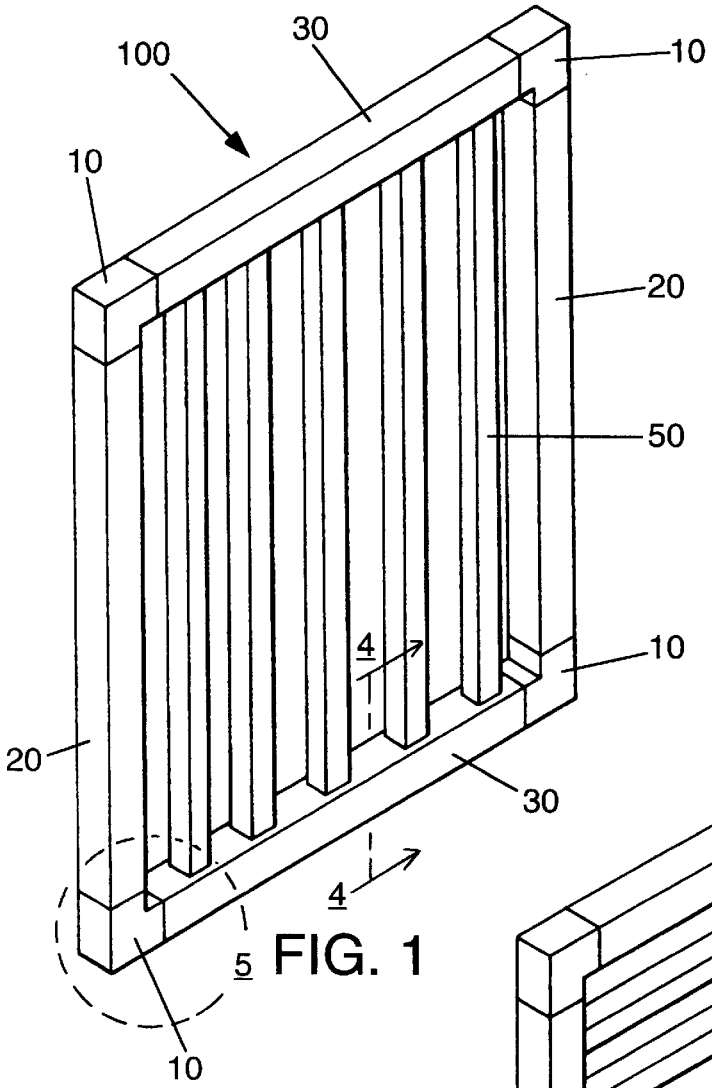
FIG. 1 is a perspective view showing the assembled PVC gate with vertical pickets.
Figure 2:
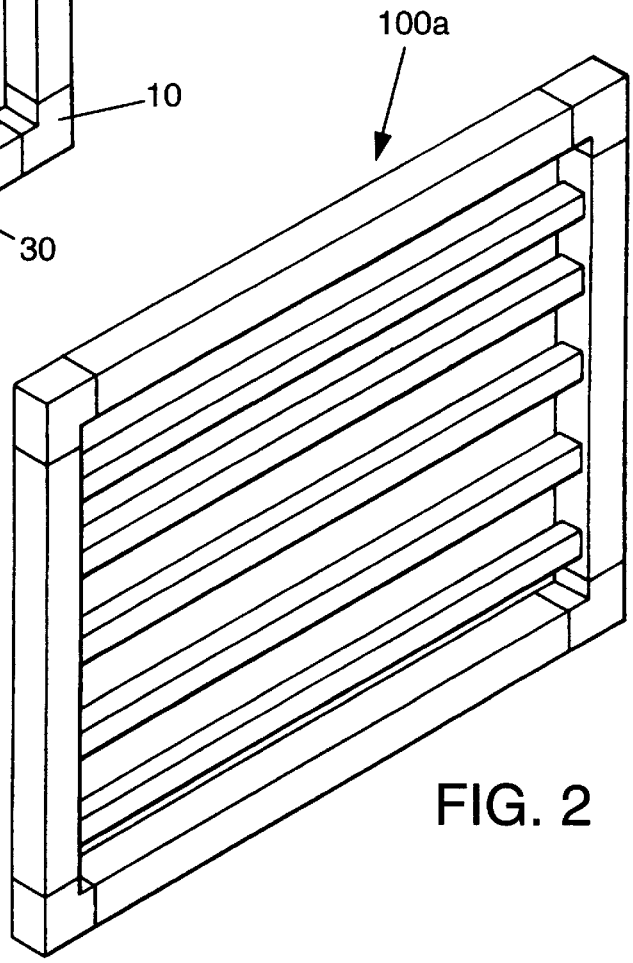
FIG. 2 is a perspective view showing the assembled PVC gate with horizontal pickets.

FIGS. 1 and 2 show in perspective views alternative preferred embodiments of the field customizable PVC gate of the claimed invention. Referring to the preferred embodiment depicted in FIG. 1, an assembled PVC gate 100 is comprised of a plurality of pickets 50 connected vertically between a pair of rail members 30. Four elbow connectors 10 join and permanently mate the ends of rail members 30 with the ends of a pair post members 20 to form the corners of gate 100.

An alternative preferred embodiment of the field customizable PVC gate structure, horizontal picket gate 100*a*, is depicted in FIG. 2. Horizontal picket gate 10*a* is structurally identical to vertical picket gate 100 of FIG. 1 with the exception that pickets 50 of gate 100*a* run horizontally between post members 20 instead of vertically between rail members 30 as in gate 100. Gate 100*a* would be used, for example, to match a surrounding fence system having horizontally oriented pickets.

Although the components of gates 100 and 100*a* may be fabricated from PVC obtained from any source, the use of virgin PVC impregnated with UV ray inhibitors serves to enhance the gates' strength and longevity. Virgin PVC generally exhibits better strength and durability characteristics as compared with PVC from recycled sources and the use of UV ray inhibitors protect the PVC against degradation due to exposure to sunlight. Known PVC UV ray inhibitors include titanium dioxide.

Figure 3:
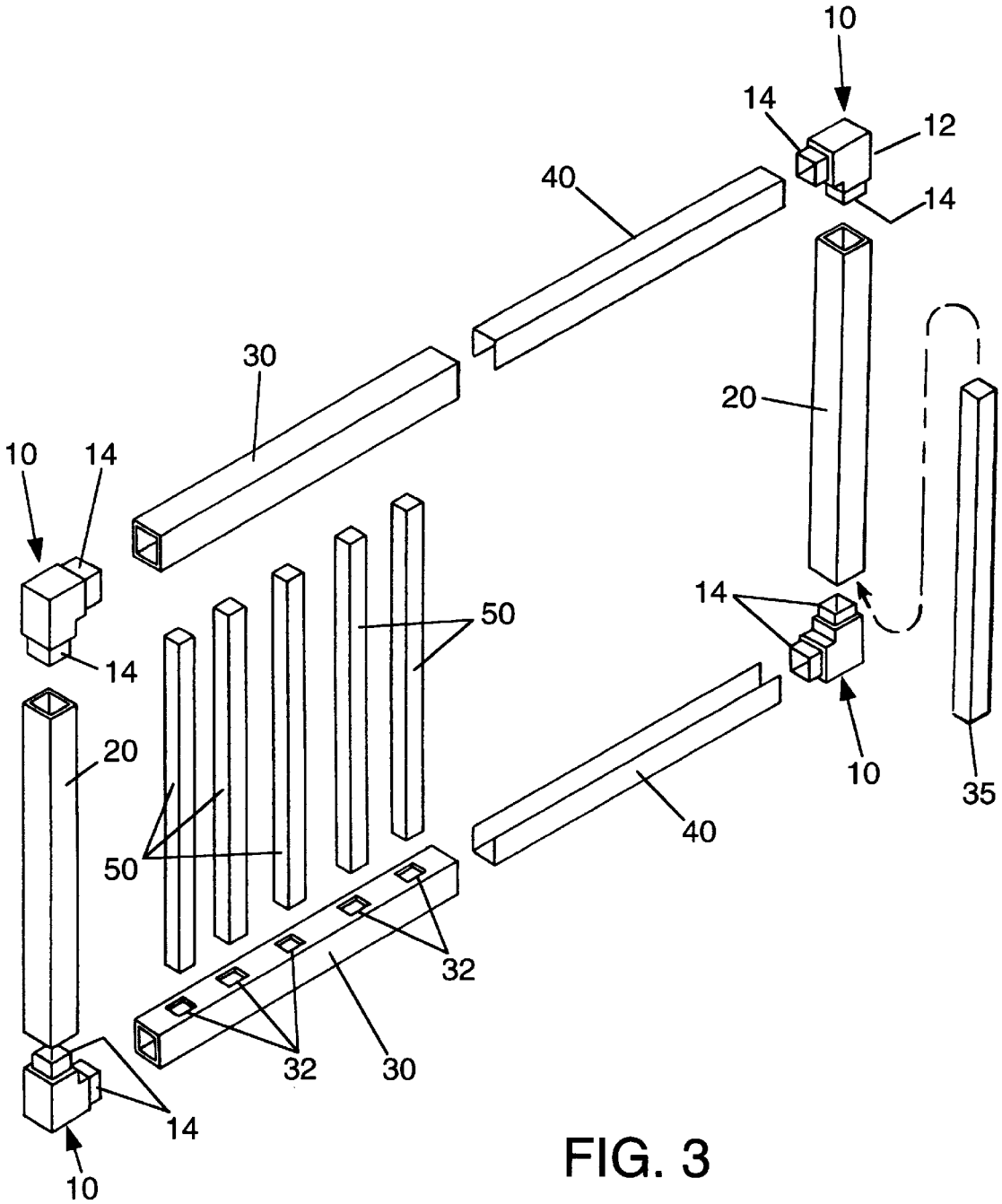
FIG. 3 is an exploded view showing all the components of the PVC gate structure, including metal U-channels.

FIG. 3 depicts PVC gate 100*a* in exploded view showing the relevant structures of elbow connector 10, other components of gate 100*a*, and the method of construction thereof. Elbow connector 10 is comprised of a hollow elbow body 12 formed of two legs which project outward at a ninety degree angle and a flange 14 extending from the outside end of each leg.

With continuing reference to FIG. 3, gate 100*a* is constructed by sizing rail members 30, post members 20, and pickets 50 to appropriate lengths taking into consideration, among other things, the dimensions and style of the surrounding PVC fence system. A wooden beam 35, sized to fit snugly within post member 20 is, according to this embodiment, inserted into each post members 20. A metal U-channel 40, sized to fit snugly within rail member 30, is inserted according to the illustrated embodiment into each rail member 30. Pickets 50 are inserted through a plurality of vertically aligned picket holes 32 cut into the inside surface of each rail member 30. PVC adhesive (not shown) is applied to flange 14 extending from elbow body 12 and to the inside of the corresponding edges of rail members 30 and post members 20. Elbow connectors 10 are then permanently mated and abutted with rail members 30 and post members 20 to form a seamless, field customizable PVC gate structure.

Although rail members 30, post members 20, pickets 50, and elbow connector assemblies 10 are depicted in FIG. 3 as rectangular in cross sections, gate components having circular, hexagonal, or any other cross sectional shapes can be utilized without departing from the intent of the subject invention.

Figure 4A:
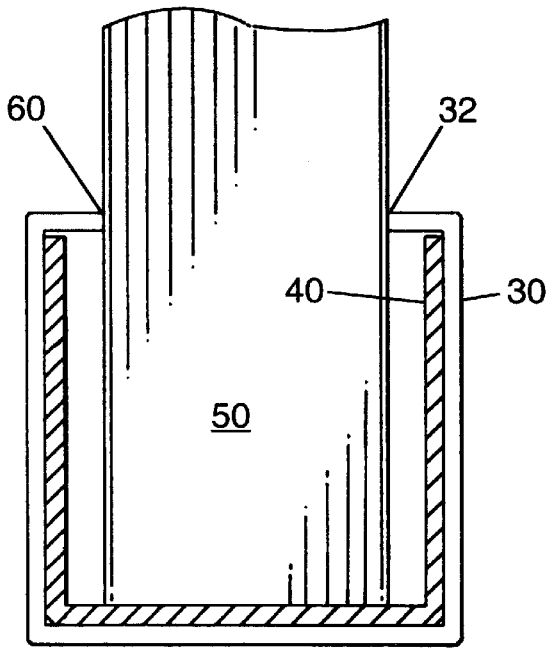
FIG. 4A is a sectional view of the bottom PVC gate rail with picket assembly, taken substantially along line 4—4 of FIG. 1, showing the, U-channel in the upright position.
Figure 4B:
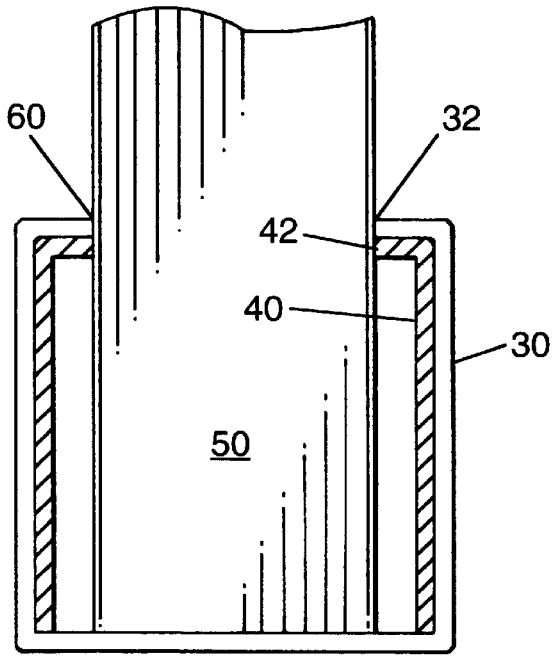
FIG. 4B is a sectional view of the bottom PVC gate rail with picket assembly, taken substantially along line 4—4 of FIG. 1, showing the U-channel in the down position.

Details of the manner in which picket 50, bottom rail member 30, and U-channel 40 interrelate is demonstrated in the alternative embodiments shown in FIGS. 4A and 4B, sectional views taken substantially along line 4—4 of FIG. 1. According to the preferred embodiment depicted in FIG. 4A, metal U-channel 40, with spine side oriented away from picket 50, sits snugly within the interior of rail member 30 and is positioned such that the end of vertical picket 50 directly abuts the inside wall of the U-channel 40 spine. The corresponding view of top rail member 30, not shown, is a mirror image of the components in FIG. 4A.

According to the alternative embodiment shown in FIG. 4B, U-channel 40, which in this embodiment demonstrates a plurality of picket holes 42 (only one of which is shown in FIG. 4B) aligned with corresponding picket holes 32 in rail 30, is inverted within rail member 30 with its spine side oriented towards picket 50. Vertical picket 50 passes first through rail picket hole 32 and then through U-channel picket hole 42. The corresponding view of top rail member 30, not shown, is a mirror image of the components in FIG. 4B.

Figure 5:
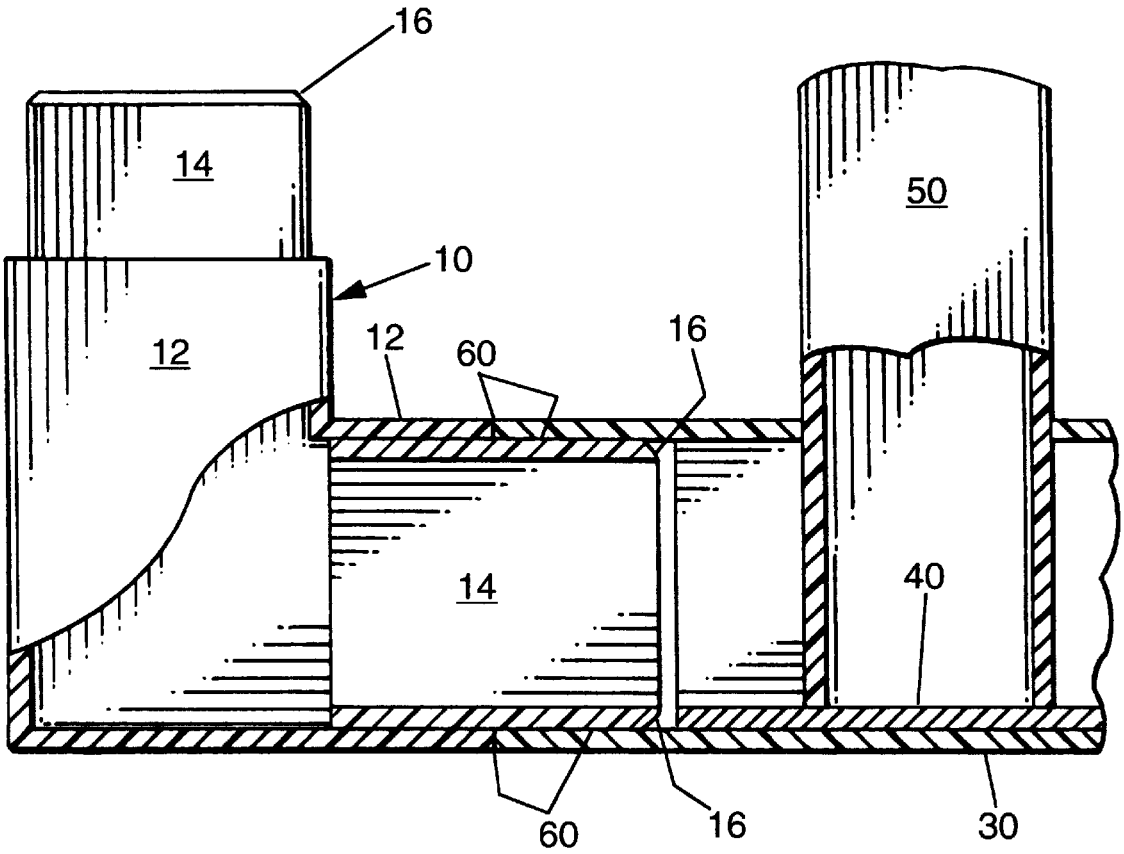
FIG. 5 is a cut-away sectional view of the elbow assembly, detail 5 of FIG. 1, showing a partial rail, U-channel, and picket.

FIG. 5 illustrates details of the manner in which rail member 30 with U-channel 40 and vertical picket 50 joins to elbow connector 10. Hollow elbow body 12 of connector 10 is molded to demonstrate legs projecting at a ninety degree angle. The walls of elbow body 12 are of the same shape, diameter and thickness as the abutting walls of connecting rail members 30 and post members 20 (not shown). Elbow flanges 14 extend from the inside wall of the elbow body 12 to provide an enhanced connective surface area for attachment with rail members 30 and post members 20.

Elbow flanges 14 of the connector 10 depicted in FIG. 5 has edges 16 that are beveled. Beveled edges 16 facilitate mating body 12 with rail members 30 and post members 20. Rail member 30 mates snugly over the outside surface of elbow flange 14, with the edge of rail member 30 abutting flush against the outside edge of elbow body 12. All contact surfaces are secured in place by a PVC adhesive 60.

Adhesive 60 can be selected from a group of commercially available adhesives including, by way of example, Oatey brand PVC solvent cements and IPS Weld-On brand adhesives and cements. Other available PVC adhesives, though not specifically identified herein, can be used with similar satisfactory results.

Also illustrated in FIG. 5 is one end of U-channel 40 fitted snugly within and reinforcing rail member 30. Vertical pickets 50 (only one of which is shown in FIG. 5) are inserted into rail member 30 through picket holes 32 so that the end of picket 50 rests upon and abuts the inside wall of U-channel 40's spine. The orientation of U-channel 40 in FIG. 5 corresponds with that illustrated in FIG. 4A, with spine side away from pickets 50.

Elbow connector 10 illustrated in FIGS. 1 through 5 is of one piece-molded construction and fabricated entirely from PVC or PVC impregnated with UV ray inhibitors. Other manners of constructing elbow connector 10 demonstrating a similar shape, and elbow connector 10 fabricated from materials other than PVC but having a PVC flange 14, or a flange 14 constructed of material which bonds PVC using a PVC adhesive, can be employed without departing from the intent of the present invention.

It will also be appreciated that, while U-channels 40 are depicted in FIGS. 3 through 5 as reinforcing rail members 30, U-channels 40 can also be employed to reinforce post members 20, or both post members 20 and rail members 30, to achieve a stronger, more durable gate structure. Beams for reinforcing post members 20 and rail members 30, fabricated from wood or metal and sized to fit snugly within members 20 and 30, can be substituted for U-channel 40 and will obtain similar results. For example, the post member 20 intended to be hinged to an adjoining fence post may be reinforced to support the hinges using U-channel 40 or a wood beam sized to fit within post member 20.

SUMMARY AND SCOPE

Accordingly, it will be readily appreciated that the elbow connector, gate and the method of constructing the present invention promote a fully field customizable, aesthetically pleasing, robust PVC gate structure that is resistant to sagging, warping, and UV ray deterioration as compared to conventional PVC gate structures.

Although the description above contains many specifications, these should not be construed as limiting the scope of the invention but merely as providing illustrations of some of the presently preferred embodiments of this invention. Many other variations are possible. For example, the flanged ends of the elbow connector can be built to varying lengths and thicknesses. In addition, various picket assemblies can be used, such as by overlapping adjacent pickets, varying picket widths, or varying spacing between pickets.

Accordingly, the scope of the invention should be determined by the appended claims and their legal equivalents, rather than by the examples given.

The embodiments of the invention in which an exclusive property or privilege is claimed are defined as follows:

What is claimed is:

1. A customizable PVC gate structure comprising:

(a) two tubular picket receiving PVC members of equal length with each said member having a plurality of picket holes formed along the inside surface of its length;

(b) two tubular non-picket receiving PVC members of equal length;

(c) a plurality of PVC pickets of equal length and having a length corresponding to the length of said non-picket receiving PVC members;

(d) a reinforcing means sized to fit snugly within said picket receiving members and configured to accommodate and communicate structurally with said pickets comprising a metal U-channel beam having a spine and sidewalls, and a plurality of holes formed along said spine corresponding to holes formed in said picket receiving members;

(e) four flanged PVC elbow connectors of a molded, one piece construction, paid elbow connectors comprising a connector body, legs shaped and sized to correspond to the shape and size of said picket receiving and said non-picket receiving members and extending from said connector body at a right angle, and flanges extending from the inside wall of the end of each said connector leg;

(f) means for permanently mating the ends of said picket and non-picket receiving members with the flanged ends of said elbow connectors;

(g) wherein said reinforcing means is placed within said picket receiving members so that its spine lies adjacent to the picket receiving side of said members;

(h) wherein each said PVC pickets are positioned between said picket receiving members with ends traversing the corresponding picket holes located along the inside surface of said two picket receiving members as well as the holes formed along the spine of said reinforcing means;

(i) and wherein each said flanged elbow connector is permanently mated to one end of a picket receiving member and one end of a non-picket receiving member by inserting said flanges within the ends of said members to form strong, low visibility, connections that join said members.

2. The PVC gate structure of claim 1, wherein the outside edge of said flanges are beveled to facilitate mating said elbow connector with said picket receiving and said non-picket receiving members.

3. The PVC gate structure of claim 1,wherein said PVC picket receiving members, non-picket receiving members, flanged elbow connectors, and pickets are fabricated of virgin PVC impregnated with UV inhibitors.

4. The PVC gate structure of claim 3, wherein said UV inhibitor is titanium dioxide.

5. The PVC gate structure of claim 1, wherein the means for permanently mating the ends of said picket and non-picket receiving members with the flanged ends of said elbow connector comprises a PVC adhesive.

6. The PVC gate structure of claim 1, wherein each of the picket receiving members are placed horizontally in said gate structure and said pickets attach vertically between said horizontal picket receiving members.

7. The PVC gate structure of claim 1, wherein each of the picket receiving members are placed vertically in said gate structure and said pickets attach horizontally between said vertical picket receiving members.

8. The PVC gate structure of claim 1, further comprising a second reinforcing means sized to fit snugly within said non-picket receiving members to strengthen said members.

9. The PVC gate structure of claim 8, wherein said second reinforcing means is a wooden beam.

* * * * *